US007089892B1

(12) United States Patent
Hosaluk et al.

(10) Patent No.: US 7,089,892 B1
(45) Date of Patent: Aug. 15, 2006

(54) FUEL INJECTION SYSTEM AND METHOD FOR TWO-CYCLE ENGINES

(75) Inventors: Lawrence J. Hosaluk, Roseau, MN (US); Darren J. Hedlund, Roseau, MN (US); Kevin D. Ness, Roseau, MN (US)

(73) Assignee: Polaris Industries Inc., Medina, MN (US)

( * ) Notice: Subject to any disclaimer, the term of this patent is extended or adjusted under 35 U.S.C. 154(b) by 0 days.

(21) Appl. No.: 10/941,315

(22) Filed: Sep. 15, 2004

(51) Int. Cl.
*F02B 25/00* (2006.01)

(52) U.S. Cl. ..... 123/73 A; 123/73 B

(58) Field of Classification Search ..... 123/73 A, 123/73 B
See application file for complete search history.

(56) References Cited

U.S. PATENT DOCUMENTS

| | | | | |
|---|---|---|---|---|
| 1,999,520 | A | 4/1935 | Stout | |
| 2,428,199 | A | 9/1947 | Buske | |
| 3,472,211 | A | 10/1969 | Meininger | |
| 4,290,394 | A | 9/1981 | Frank et al. | |
| 4,706,618 | A | 11/1987 | Laimbock | |
| 4,840,148 | A | 6/1989 | Staerzl | |
| 4,922,866 | A | 5/1990 | Staerzl et al. | |
| 4,960,097 | A | 10/1990 | Tachibana et al. | |
| 5,027,759 | A | 7/1991 | Luo | |
| 5,092,288 | A | 3/1992 | Staerzl | |
| 5,133,829 | A | 7/1992 | Geyling | |
| 5,363,814 | A | 11/1994 | Daikoku | |
| 5,673,671 | A | 10/1997 | Kato | |
| 5,700,402 | A | 12/1997 | Jones et al. | |
| 5,803,050 | A | 9/1998 | Osakabe et al. | |
| 6,305,354 | B1 | 10/2001 | Kato | |
| 6,539,900 | B1 | 4/2003 | Laimbock | |
| 6,729,275 | B1 * | 5/2004 | Laimbock | 123/73 PP |

* cited by examiner

*Primary Examiner*—Noah P. Kamen
(74) *Attorney, Agent, or Firm*—Baker & Daniels LLP

(57) ABSTRACT

A straddle seat type vehicle with a two-cycle internal combustion engine with a crankcase fuel injector. The crankcase fuel injector is mounted through a wall of the crankcase and injects fuel in a jet directed at incoming air entering into the crankcase. The engine may also include a transfer passage fuel injector that injects fuel in a jet directed generally transverse to the direction of airflow through the transfer passage.

50 Claims, 17 Drawing Sheets

FUEL INJECTION SYSTEM AND METHOD FOR TWO-CYCLE ENGINES

FIELD OF THE INVENTION

This disclosure relates to the field of fuel injection systems for two-cycle engines.

BACKGROUND OF THE INVENTION

Two-cycle engines are utilized in a variety of applications. Because their power to weight ratios are substantially greater than their four-cycle counterparts, and because they can operate regardless of orientation, they are especially useful for straddle seat type vehicle applications, such as snowmobiles, all-terrain vehicles (ATVs), personal watercrafts (PWCs), and motorcycles. Unfortunately, many currently available two-cycle engines are fuel inefficient, emit an undesirable amount of pollution, and/or exhibit poor running quality. Part of these undesirable characteristics may be attributed to the placement of fuel injectors within the engine.

BRIEF SUMMARY OF THE INVENTION

Some embodiments of the invention include a straddle seat type vehicle with a two-cycle internal combustion engine, a straddle seat, and a chassis supporting the engine and the seat. The engine includes a cylinder with a piston, a cylinder head, and a crankcase. The engine also includes an air inlet for introducing air into the crankcase and a crankcase fuel injector passing through a wall of the crankcase for injecting fuel into the crankcase. The crankcase fuel injector injects fuel in a jet that defines a central jet axis. The air inlet introduces air into the crankcase in an airflow that defines a central airflow axis. The engine is arranged such that the central jet axis is directed generally opposite to the central airflow axis.

In some embodiments, the invention includes a transfer passage between the cylinder and the crankcase, and a transfer passage fuel injector located to direct fuel into the transfer passage. Some embodiments of the invention also include a method of injecting fuel into a two-cycle internal combustion engine. The invention permits more accurate fuel delivery calibration, resulting in reduced fuel consumption, reduced emissions, improved running quality, and improved engine durability.

DETAILED DESCRIPTION OF THE INVENTION

The following detailed description should be read with reference to the drawings, in which like elements in different drawings are numbered identically. The drawings, which are not necessarily drawn to scale, depict selected embodiments and are not intended to limit the scope of the invention. Several forms of the embodiments will be shown and described, and other forms will be apparent to those skilled in the art. It will be understood that embodiments shown in drawings and described are merely for illustrative purposes and are not intended to limit the scope of the embodiments as defined in the claims that follow.

Figure 1:
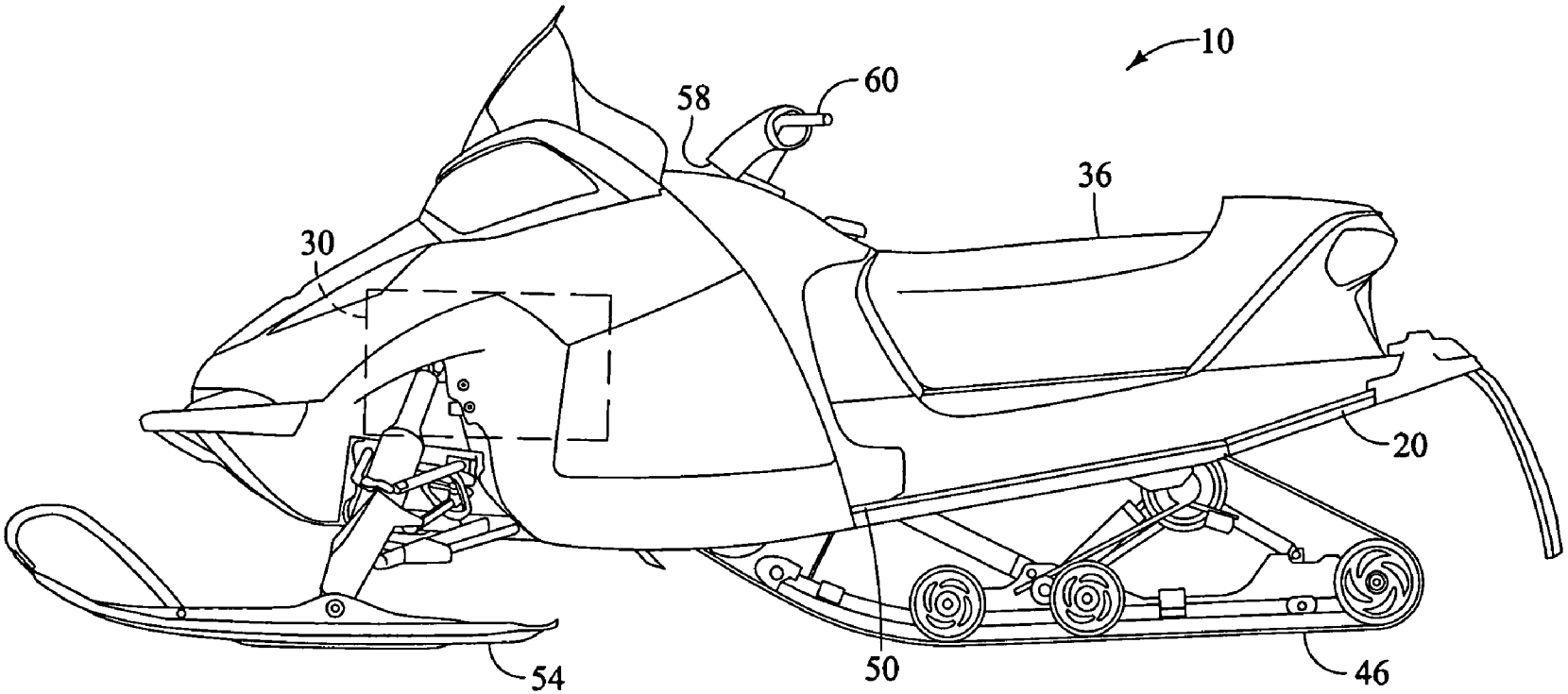
FIG. 1 shows a side plan view of a snowmobile in accordance with an embodiment of the invention.

A snowmobile 10 in accordance with an embodiment of the invention is shown in FIG. 1. Generally, snowmobile 10 includes a longitudinally extending chassis 20. The chassis 20 supports and mounts several vehicle components, including an engine 30, a straddle type seat 36, footrests 50, at least one ground engaging element, such as a drive track 46, or a pair of steerable skis 54. The seat 36 is adapted to accommodate a rider in straddle fashion, and the engine 30 powers the drive track 46 operatively connected to the chassis 20. A steering post 58 is operatively connected to the pair of skis 54. Handlebars 60 to effect steering may be provided.

Figure 2:
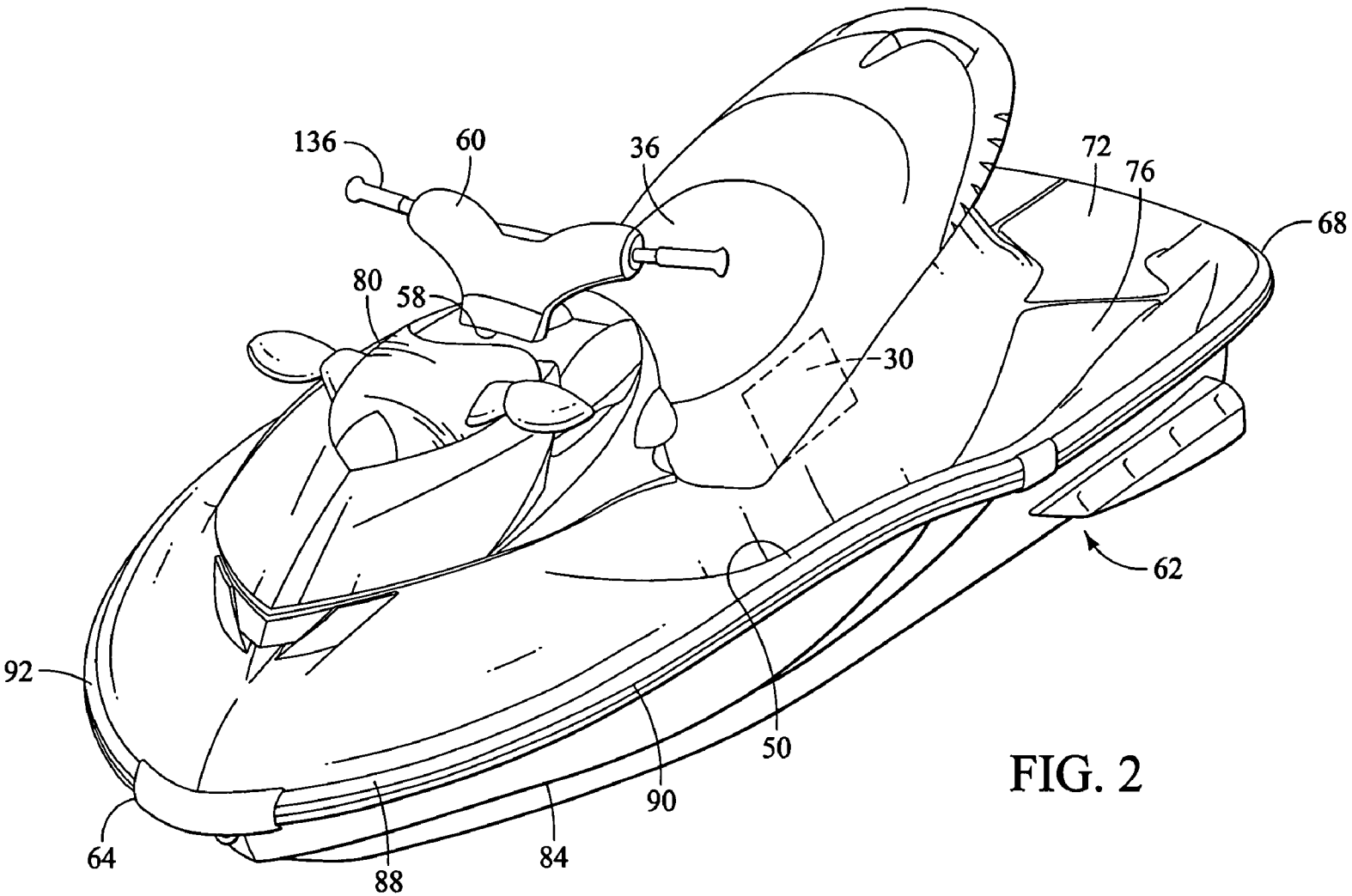
FIG. 2 shows a perspective view of a personal watercraft in accordance with an embodiment of the invention.

A watercraft 62 in accordance with an embodiment of the invention is shown in FIG. 2. Watercraft 62 has generally a front or bow 64 and a rear or stern 68 and includes an upper portion 72 that includes a top deck 76 and shroud 80. The top deck 76 is secured to a bottom hull 84 along an overlapping portion 88 covered with a rub rail 90, thereby forming a hull 92. The hull 92 can serve as a chassis 20' for mounting and supporting other watercraft vehicle components. The hull 92 formed by the bottom hull 84 and top deck 76 defines a compartment sized to house an internal combustion engine 30' for powering the watercraft 62. The deck 76 also has a raised, longitudinally extending seat 36' adapted to accommodate one or more riders seated in straddle fashion. A footrest 50' area is also provided. A steering post 58' is operatively connected to a jet useful for providing steering to the watercraft 62. In this example, the jet may be considered an at least one ground engaging element. Handlebars 60' supported by the steering post 58' may be provided for rotating the steering post 58 to effect steering.

Figure 3:
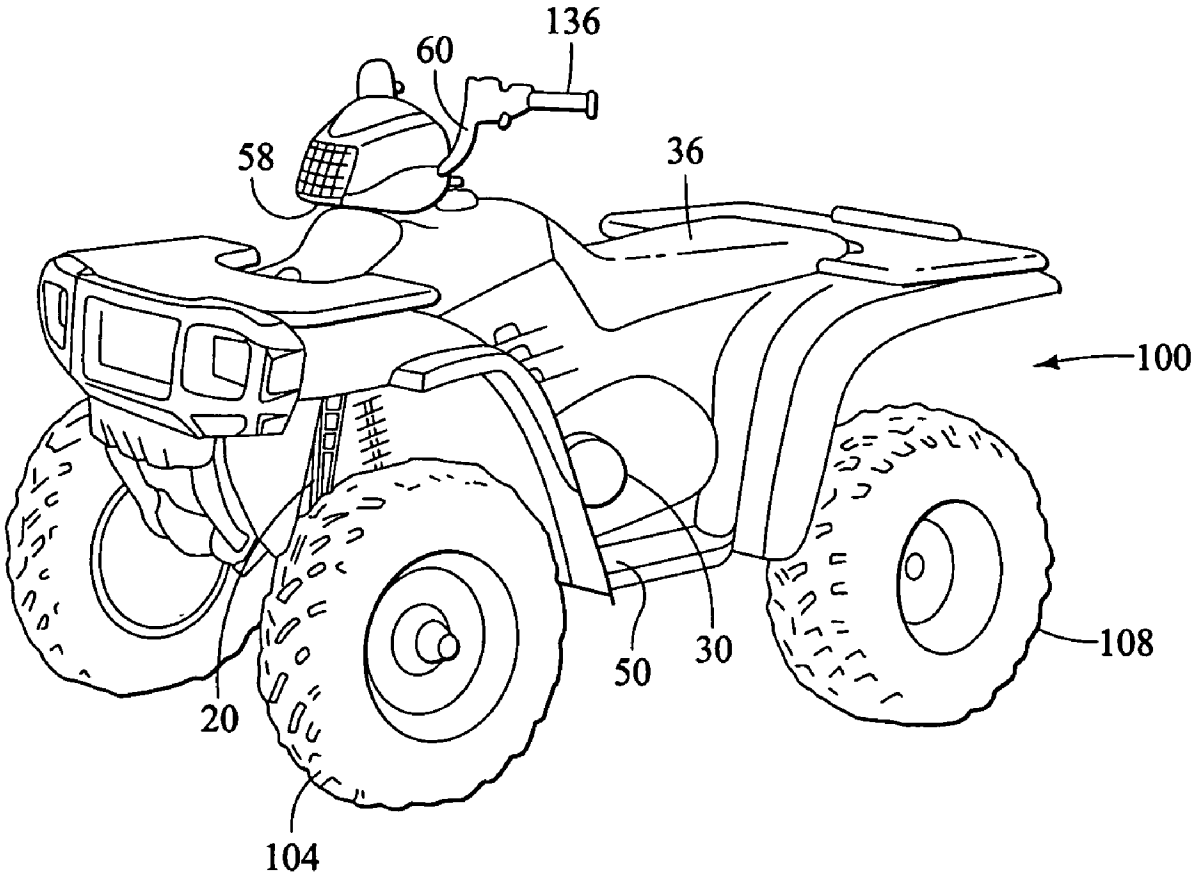
FIG. 3 shows a perspective view of an all terrain vehicle in accordance with an embodiment of the invention.

An ATV 100 in accordance with an embodiment of the invention is shown in FIG. 3. ATV 100 includes a chassis 20", at least one ground engaging element, such as two front wheels 104 and two rear wheels 108, a straddle-type seat 36", laterally extending footrests 50" on opposite sides of the vehicle, and an engine 30" located generally beneath the straddle-type seat 36" and substantially between the footrests 50". A steering post 58" is operatively connected to the pair of wheels 104. Handlebars 60" supported by the steering post 58" may be provided for rotating the steering post 58" to effect steering.

Figure 4:
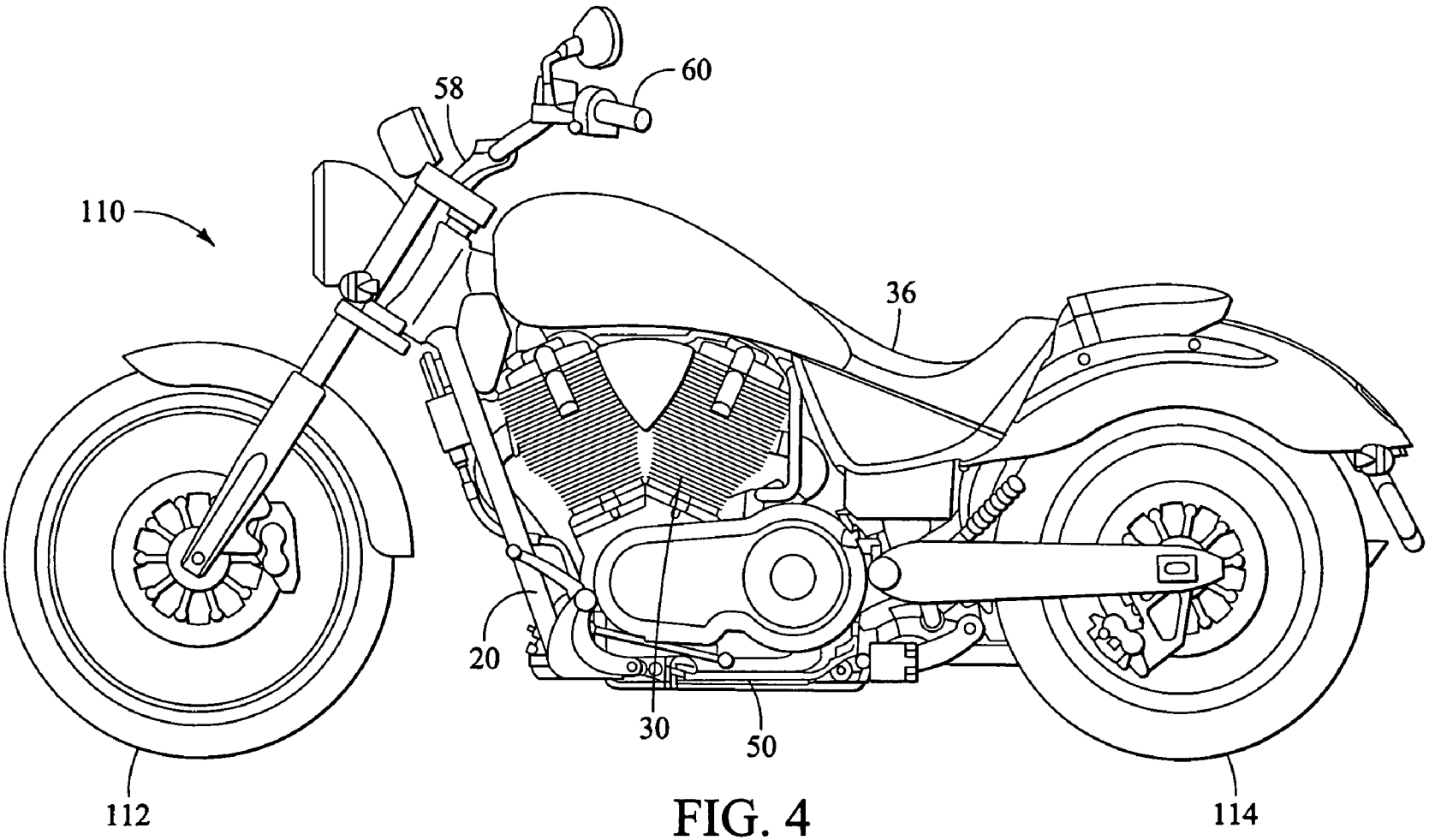
FIG. 4 shows a side plan view of a motorcycle in accordance with an embodiment of the invention.

A motorcycle 110 in accordance with an embodiment of the invention is shown in FIG. 4. Motorcycle 110 includes a chassis 20'", at least one ground engaging element, such as front wheel 112 and rear wheel 114, a straddle-type seat 36'", laterally extending footrests 50'" on opposite sides of the vehicle, and an engine 30'" carried by the chassis 20'". A steering post 58'" is operatively connected to the front wheel 112. Handlebars 60'" supported by the steering post 58'" may be provided for rotating the steering post 58'" to effect steering.

Similar components on each vehicle are identified above with like names and element numbers. Distinctions between such components are indicated above with the use and non-use of one or more primes after the element number. In order to simplify the discussion hereinafter, no prime indicators are used. It is understood, however, that all references to elements defined in multiple vehicle types (e.g., chassis 20, engine 30, seat 36, footrest 50, steering post 58, handlebars 60, etc.) may apply to each of such vehicles. It is understood that the discussion may apply equally to other straddle seat type vehicles.

Figure 5:
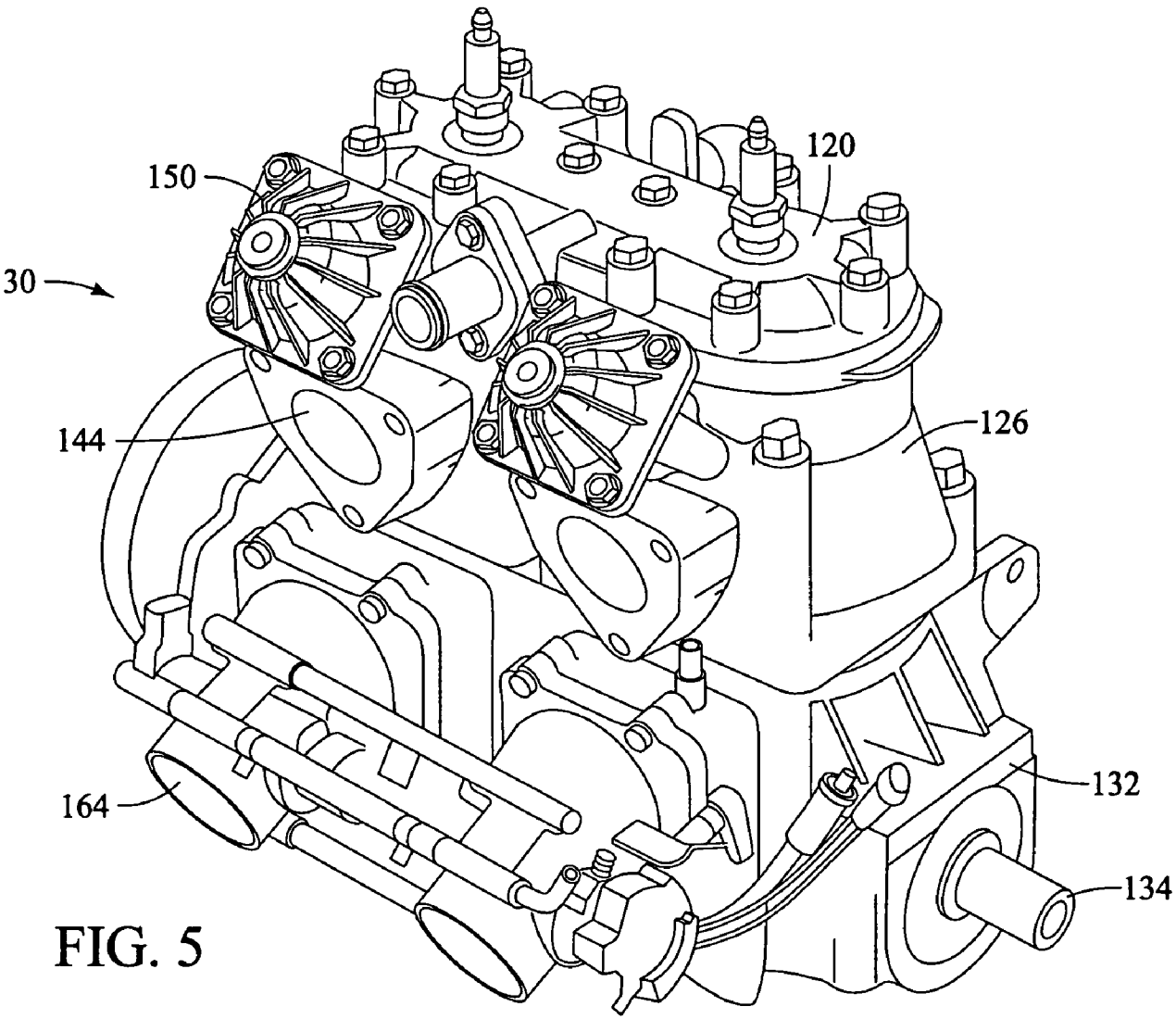
FIG. 5 shows a perspective view of an engine in accordance with an embodiment of the invention.
Figure 6:
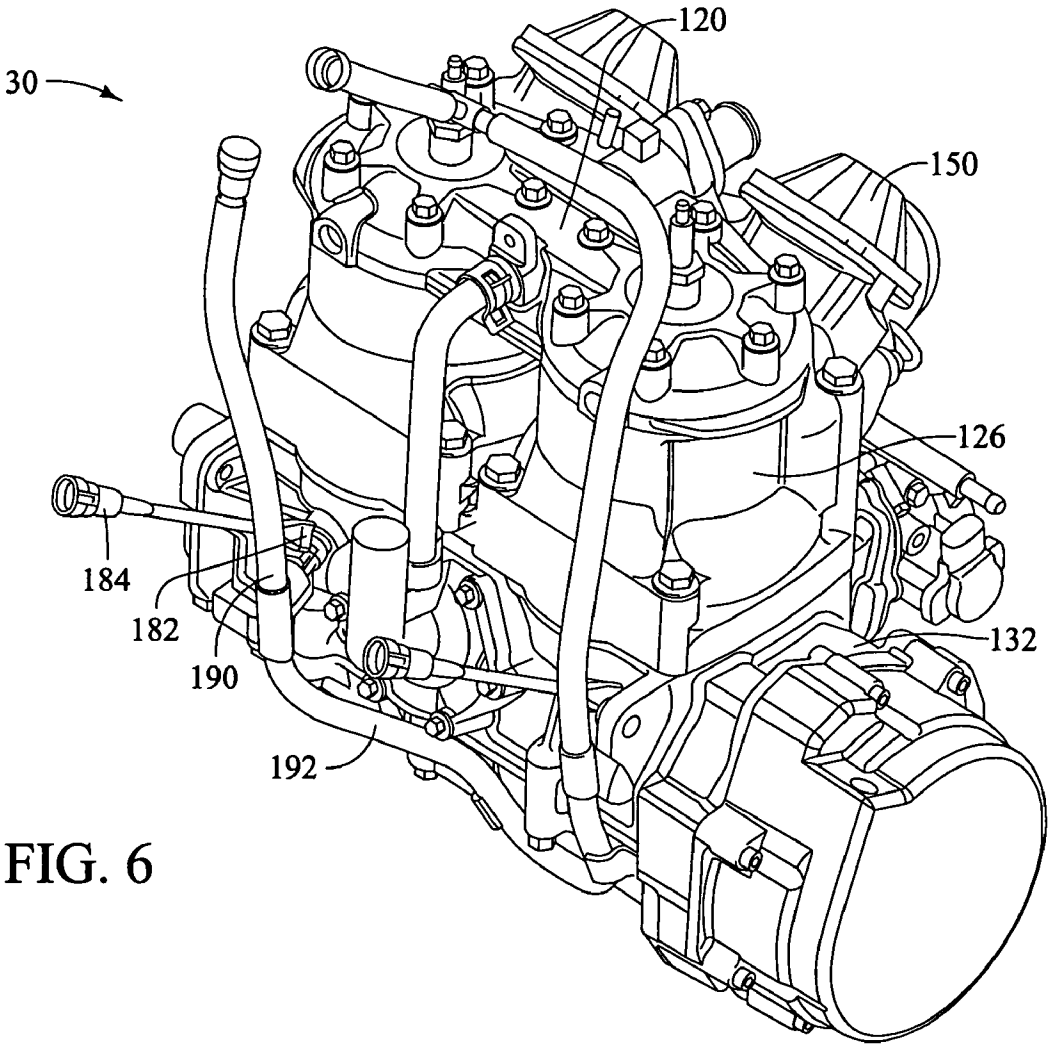
FIG. 6 shows a perspective view of an engine in accordance with an embodiment of the invention.
Figure 12A:
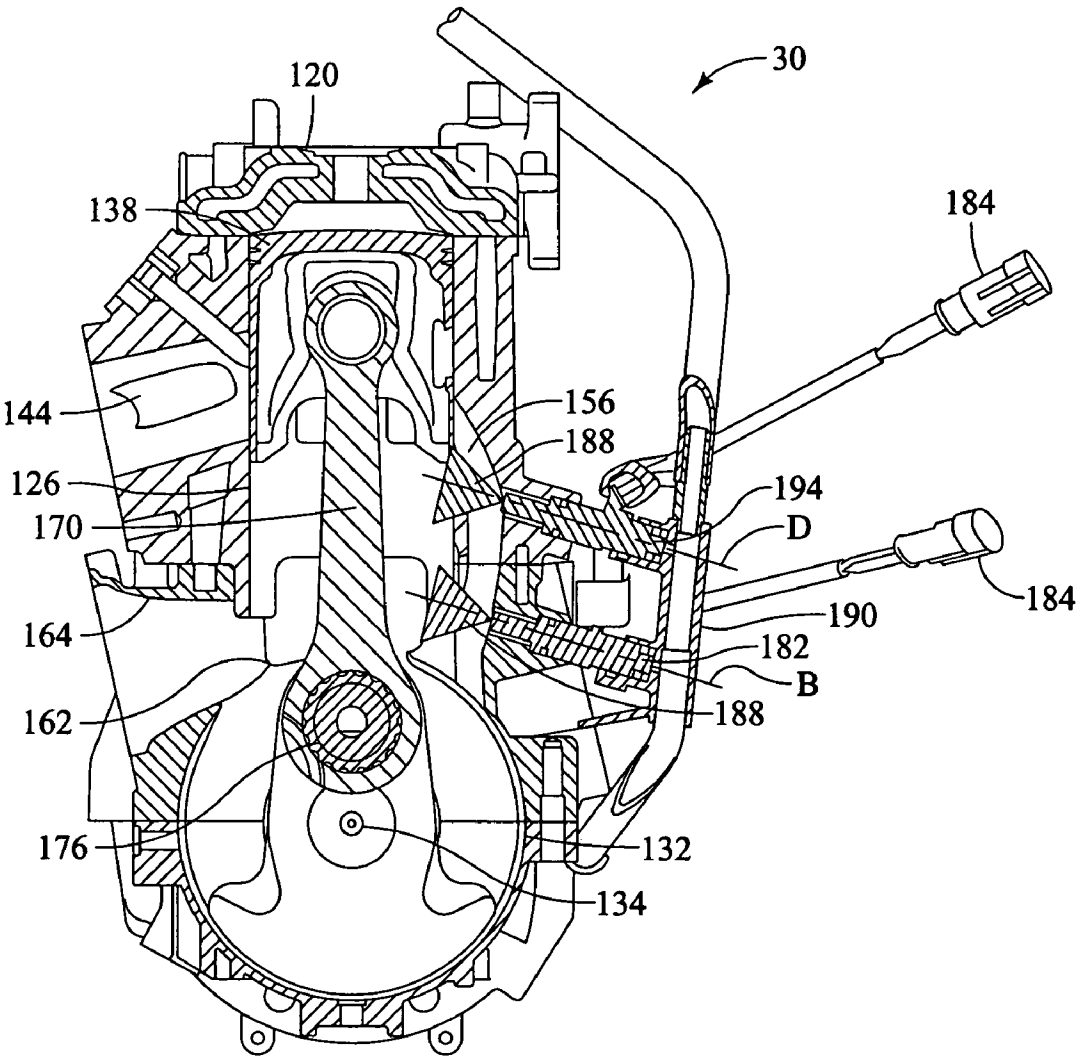
FIG. 12A shows a cross-section schematic plan view of an engine in accordance with an embodiment of the invention.
Figure 12B:
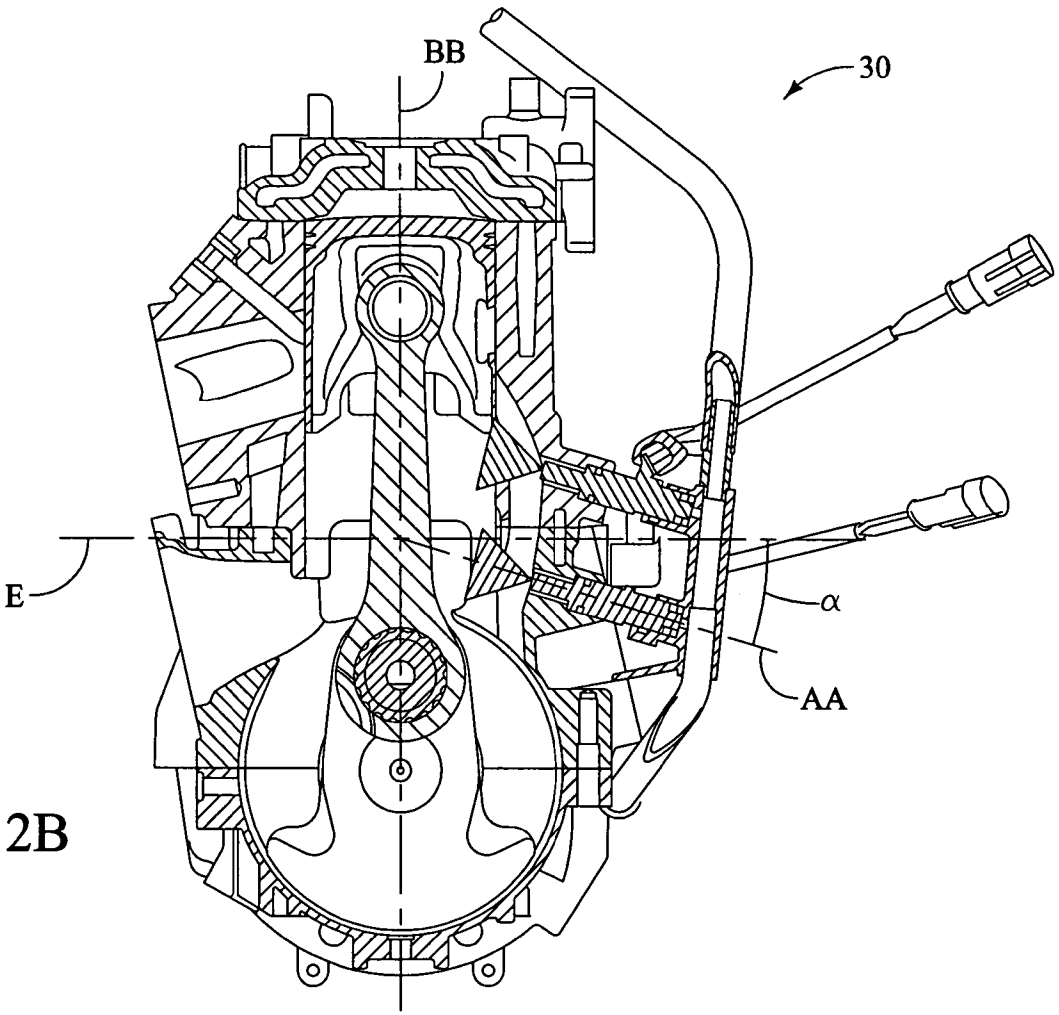
FIG. 12B shows the cross-section schematic plan view of FIG. 12A including certain defined axes and angles in accordance with an embodiment of the invention.
Figure 12C:
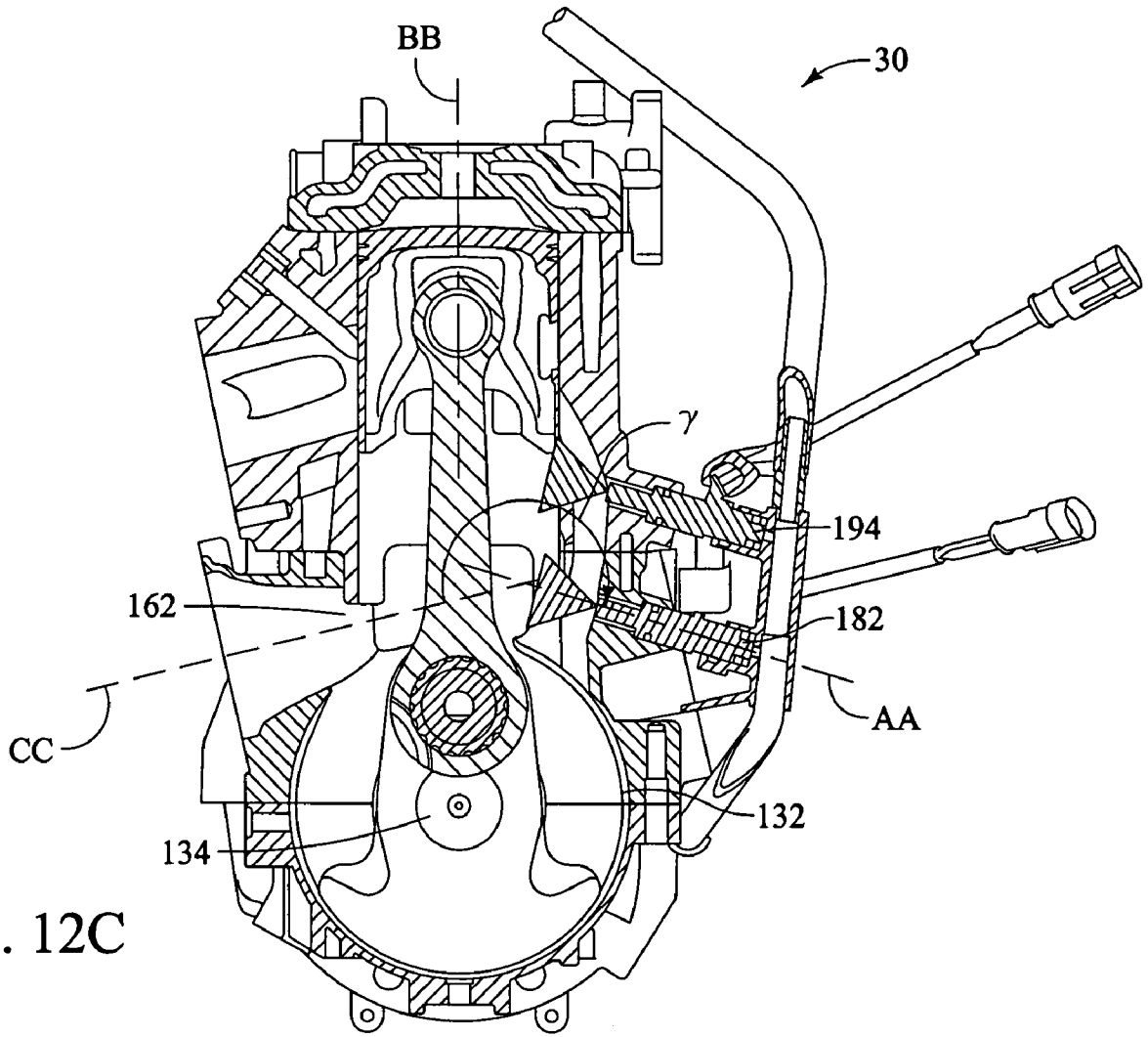
FIG. 12C shows the cross-section schematic plan view of FIG. 12A including certain defined axes and angles in accordance with an embodiment of the invention.
Figure 13:
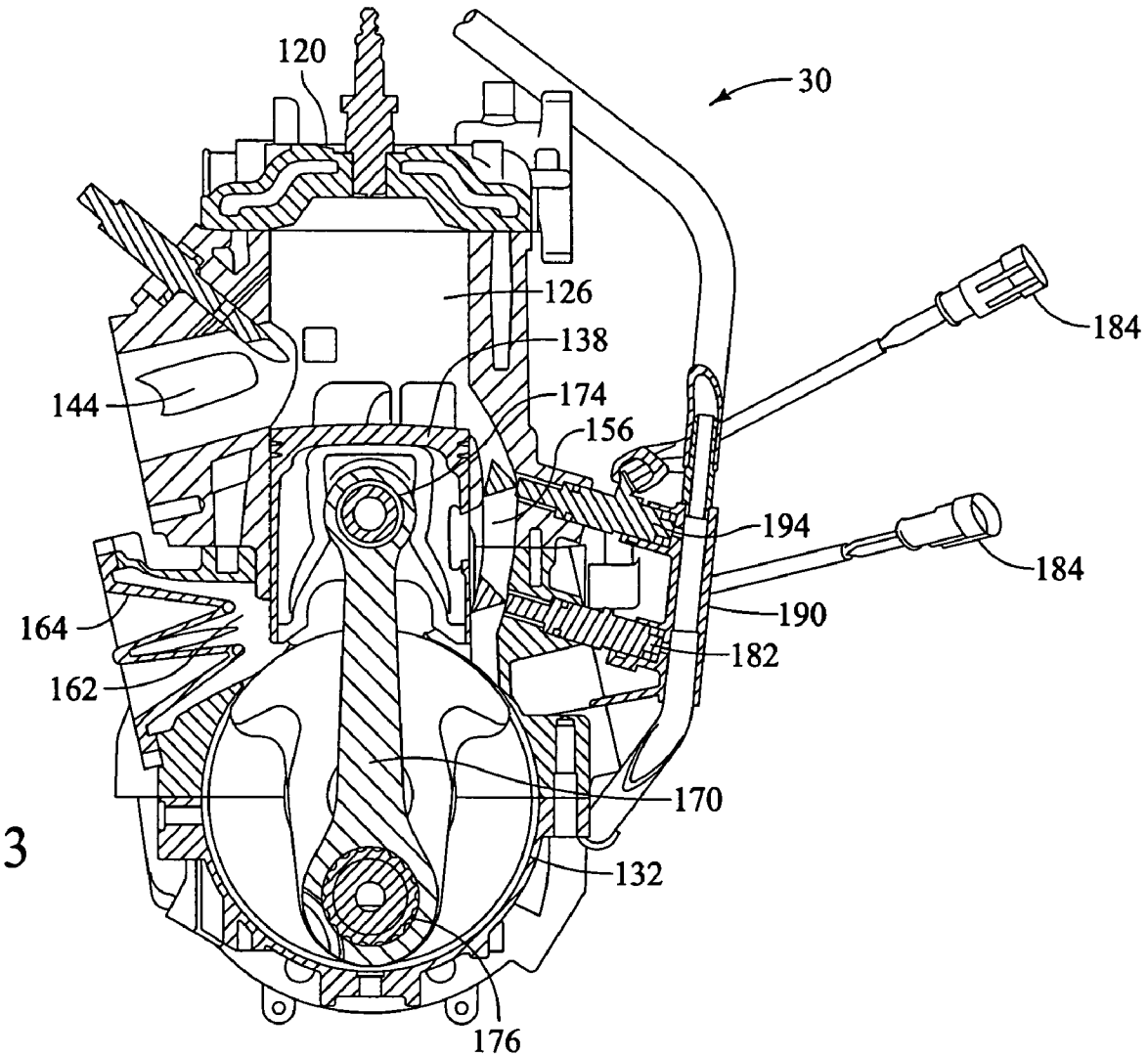
FIG. 13 shows a cross-section schematic plan view of an engine in accordance with an embodiment of the invention.

The engine 30 is of the two-cycle (sometimes referred to herein as two-stroke) type. As shown in FIG. 5, the engine 30 is formed of a head assembly 120 mounted atop one or more cylinders 126, which are in turn mounted atop a crankcase 132. Of course, cylinder 126 and crankcase 132 may be formed in a single piece. A crankshaft 134 rotates within crankcase 132. As shown in FIGS. 7–10 and 12A–C, a piston 138 reciprocates in the cylinder 126 between a top dead center position (as shown in FIGS. 12A–C) and a bottom dead center position (as shown in FIG. 13). The cylinder 126 includes at least one exhaust port 144 and, in some embodiments, an exhaust tuning valve 150. Cylinder 126 may also include one or more transfer passages 156, and a means for introducing air, such as an air inlet assembly 162 positioned on one side of the crankcase 132. Air inlet assembly 162 could include, for example, a reed valve positioned in a housing 164. Alternatively, the air inlet could be a port or orifice in the cylinder that may be controlled by the piston skirt. That is, the reciprocal movement of the piston could open and shut the air inlet assembly 162. Further, the air inlet could be a rotary valve mounted in crankcase 132.

As shown in the FIGS. 7–10 and 12A–13, the air inlet assembly 162 may be positioned on one side of the crankcase 132, near the junction between the crankcase and the cylinder 126. In an alternate embodiment, the air inlet assembly 162 could be positioned in the cylinder, near the junction between the crankcase and the cylinder.

Figure 7:
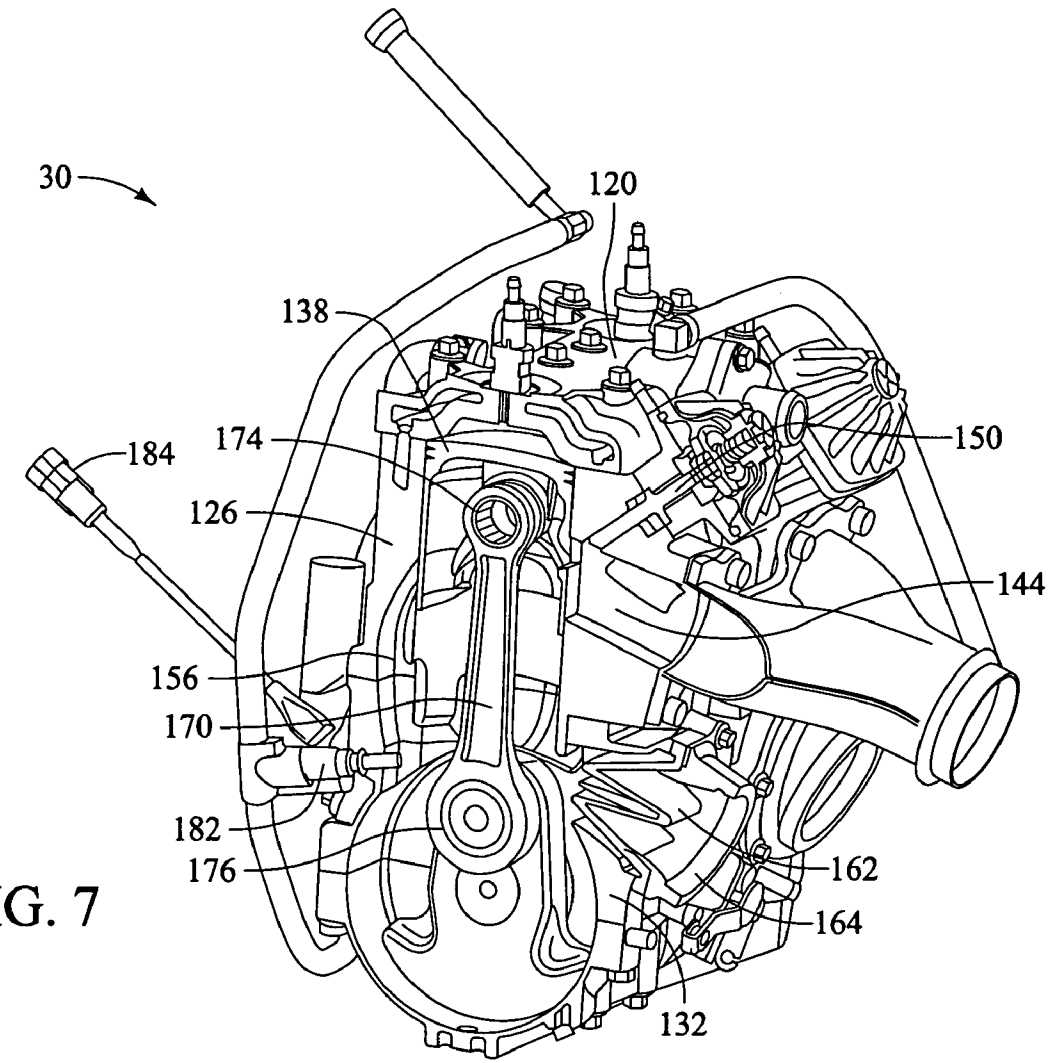
FIG. 7 shows a cross-section perspective view of an engine in accordance with an embodiment of the invention.
Figure 8:
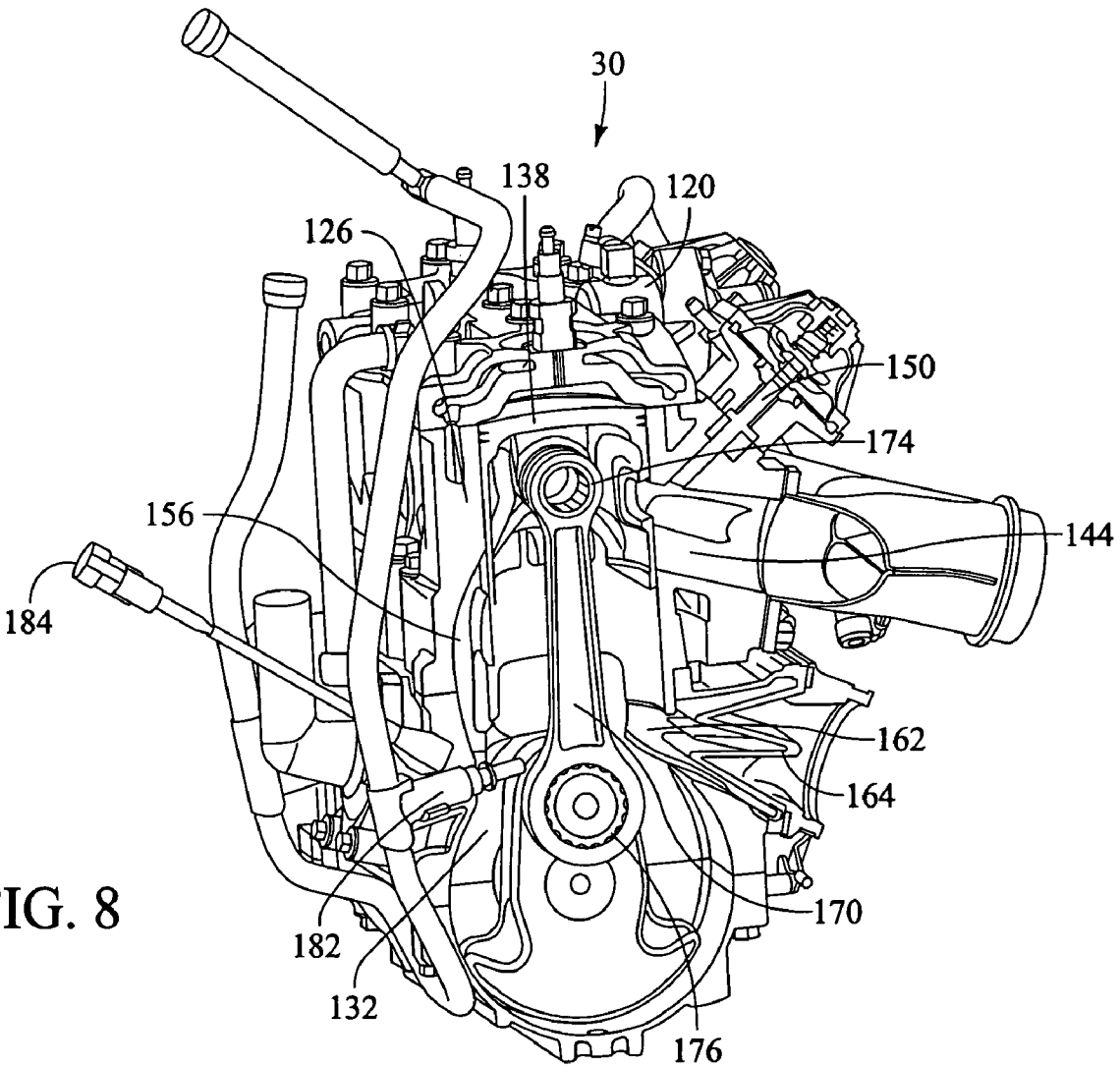
FIG. 8 shows a cross-section perspective view of an engine in accordance with an embodiment of the invention.

The piston 138 may connect to crankshaft 134 in a conventional fashion via a connecting rod 170, an upper connecting rod bearing 174 and a lower connecting rod bearing 176, as shown in FIGS. 7 and 8. A crankcase fuel injector 182 may be mounted through a wall of crankcase 132, as shown in FIGS. 6–13. At least one crankcase fuel injector 182 is provided per cylinder 126. Crankcase fuel injector 182 may be of any type and may be electronically controlled. For example, fuel injector 182 may be a single-orifice, single-spray cone type injector, a multiple-orifice, single-spray cone type injector, or a multiple-orifice, dual-spray cone type injector. A harness 184 may be coupled to crankcase fuel injector 182 to facilitate communication with an engine control unit (not shown), which controls injector operation based on input sensor data and appropriate calculations.

Figure 8A:
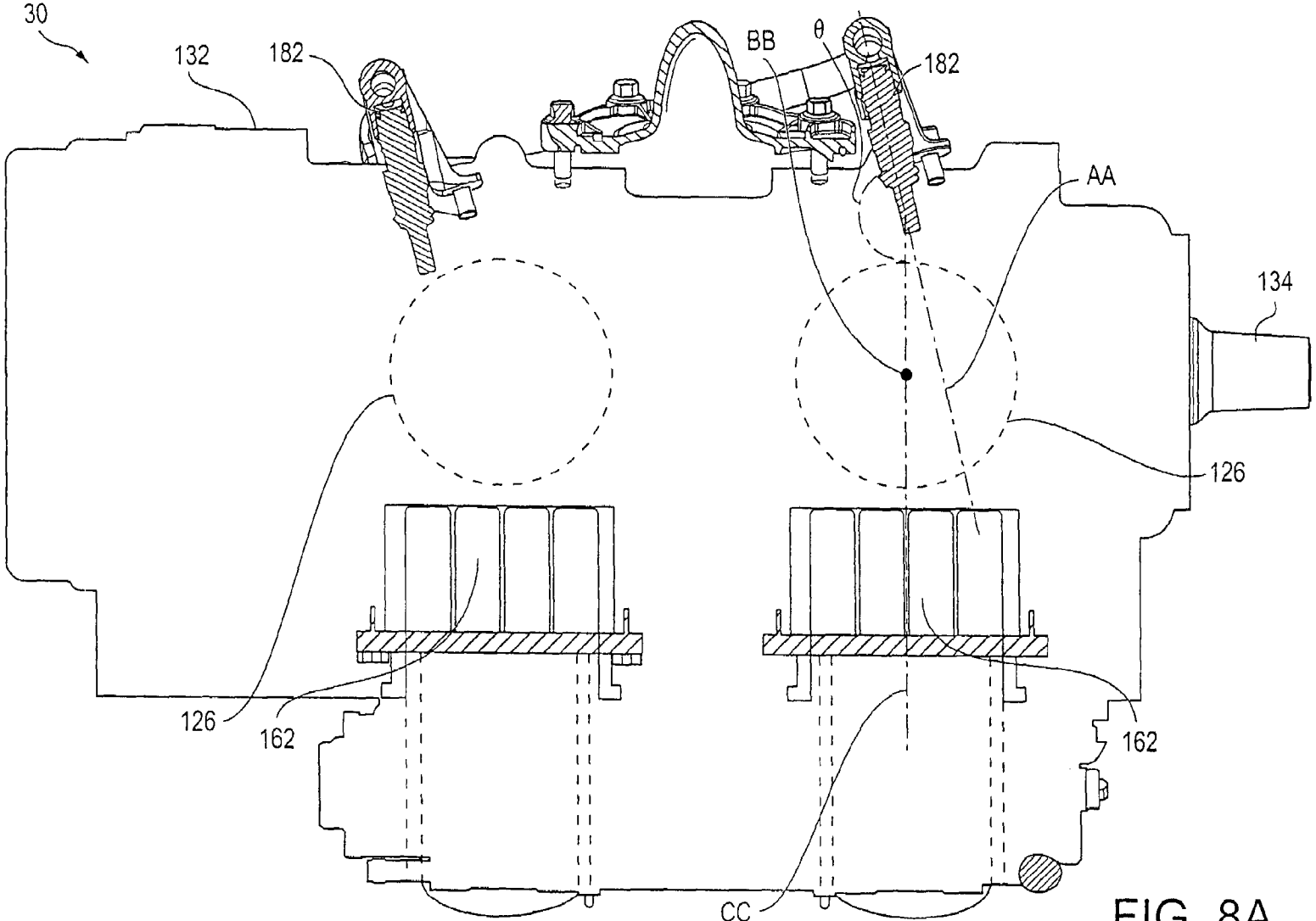
FIG. 8A shows a cross-section top view of an engine in accordance with an embodiment of the invention.
Figure 9:
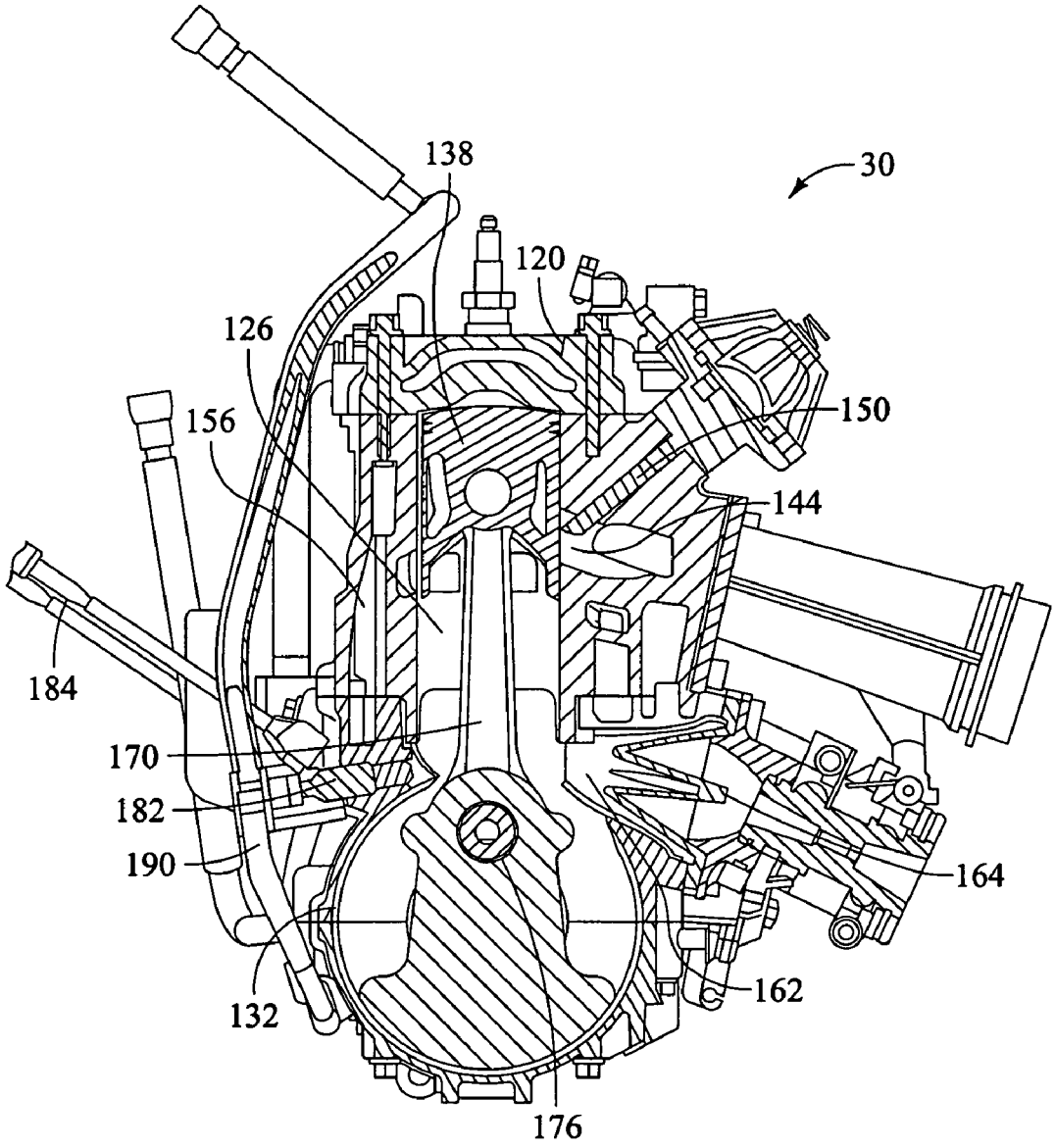
FIG. 9 shows a cross section schematic plan view of an engine in accordance with an embodiment of invention.
Figure 10:
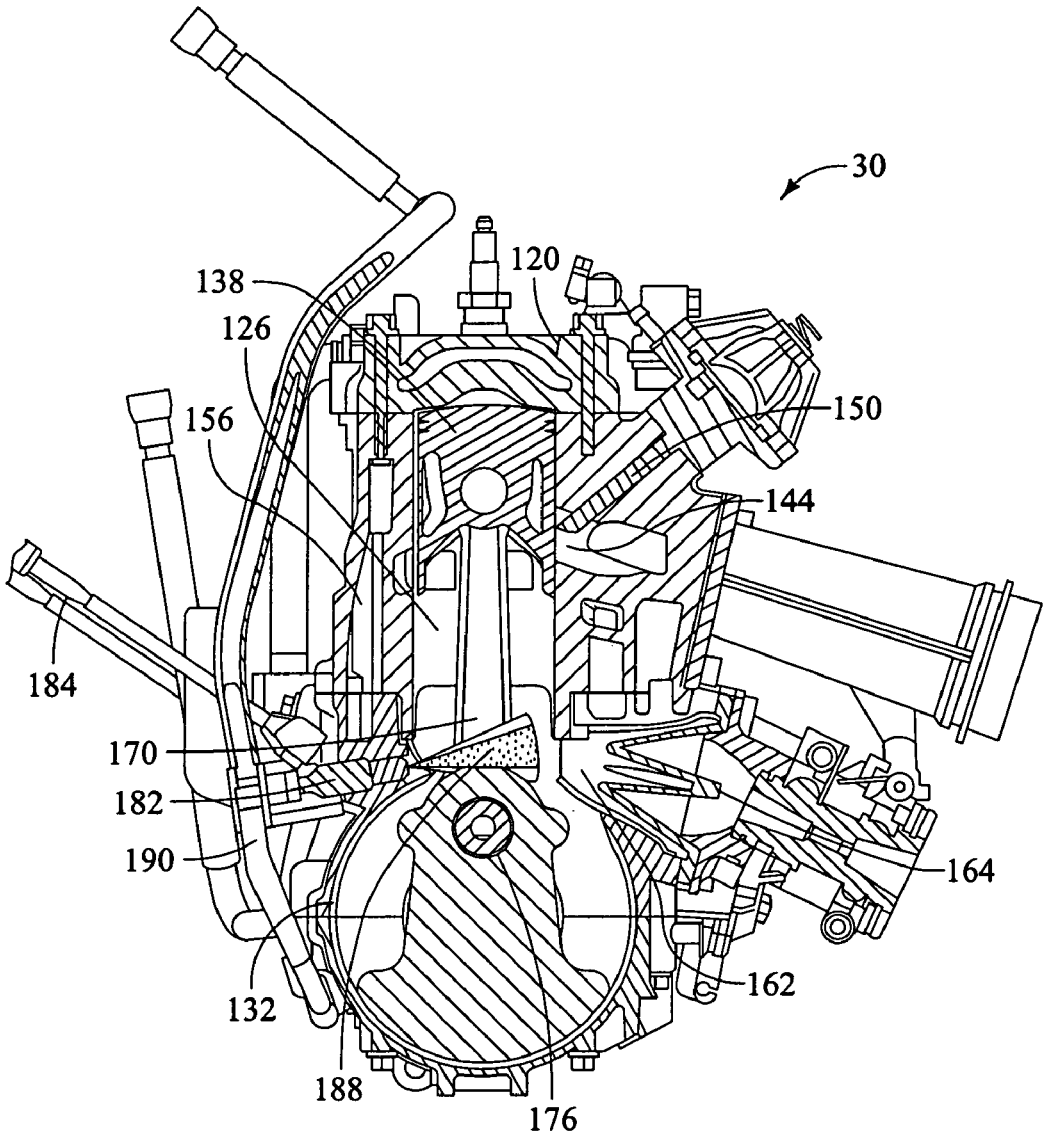
FIG. 10 shows a cross-section schematic plan view of an engine in accordance with an embodiment of the invention.

The crankcase fuel injector 182 may be provided through a wall of the crankcase 132, and may inject fuel into the crankcase 132 below the piston 138 and/or cylinder 126. The injected fuel mixes with air entering the crankcase 132 via the air inlet assembly 162. In some embodiments, cylinder 126 has an internal cavity of substantially cylindrical shape and defines a central cylinder axis BB, as shown in FIGS. 8A and 12B. Air flow out of air inlet assembly 162 and into crankcase 132 may define a central airflow axis CC, as shown in FIGS. 8A and 12C. In such embodiments, crankcase fuel injector 182 may inject fuel in a fuel jet having a central jet axis. AA, as shown in FIGS. 8A and 12C. Jet axis AA may be in a direction generally opposite the direction of the central airflow axis CC when viewed in a direction from the cylinder head 120 towards the crankcase 132 and/or when viewed in a direction perpendicular to the central cylinder axis BB. Such a location may increase fuel atomization because the orientation of the inlet air stream and inlet fuel stream promotes mixing and atomization of the fuel.

One or more of the various axes discussed above may be further oriented to obtain reduced fuel consumption, reduced emissions, improved running quality, and improved engine durability. In some embodiments, the crankcase fuel injector jet axis AA is directed at an angle $\alpha$ of between 0 and 20 degrees from a plane E normal to the central cylinder axis BB, as shown in FIG. 12B. In some embodiments, crankcase fuel injector jet axis AA and central airflow axis CC conjointly form an angle $\theta$ of between 90 and 270 degrees when viewed in the direction from the cylinder head 120 towards the crankcase 132, as shown in FIG. 8A. Further, crankcase fuel injector jet axis AA and central airflow axis CC conjointly may form an angle $\gamma$ of between 90 and 270 degrees when viewed in the direction perpendicular to the central cylinder axis BB (e.g., parallel to the crankshaft 134 axis), as shown in FIG. 12C. In some embodiments, crankcase fuel injector jet axis AA and central axis A of the crankcase fuel injector are the same. In other embodiments, crankcase fuel injector jet axis AA may be skewed from central axis A of the crankcase fuel injector.

Upward movement of the piston 138 creates a pressure differential across the inlet 162 that in turn causes combustion air to pass into the crankcase 132. As the piston 138 moves downwardly, the combustion air or fuel and combustion air mixture (sometimes referred to herein as fluid) in the crankcase 132 is compressed and eventually is forced under pressure into the combustion chamber above the piston 138 where combustion may then take place. In some embodiments, the combustion air or fuel and combustion air mixture is forced from the crankcase to the combustion chamber via one or more transfer passages 156. Transfer passages 156 may be any channel or aperture useful for fluid communication between the crankcase 132 and the combustion chamber.

The invention may include further specific placements of the crankcase fuel injector 182 to increase fuel efficiency, promote complete combustion, and/or reduce fuel contact on surfaces where it is not desired. For purposes of illustration, a fuel spray pattern is represented by fuel spray cone 188 in FIGS. 10 and 12A–C. In some embodiments, the crankcase fuel injector 182 is positioned to inject fuel below the piston 138. The crankcase fuel injector 182 may also be positioned to inject fuel above the crankshaft 134. In some embodiments, the crankcase fuel injector 182 is positioned to spray fuel so it does not substantially impinge on the lower connecting rod bearing 176 (i.e., does not impinge to an undesirable extent). For example, crankcase fuel injector 182 may spray fuel above the highest point reached by lower connecting rod bearing 176 as it travels through its revolution path. The crankcase fuel injector 182 may be further positioned to spray fuel so it does not substantially impinge on an internal surface of the crankcase 132. In particular, these locations for crankcase fuel injector 182 reduce fuel impingement on surfaces where it may remove lubricating oil.

Figure 12D:
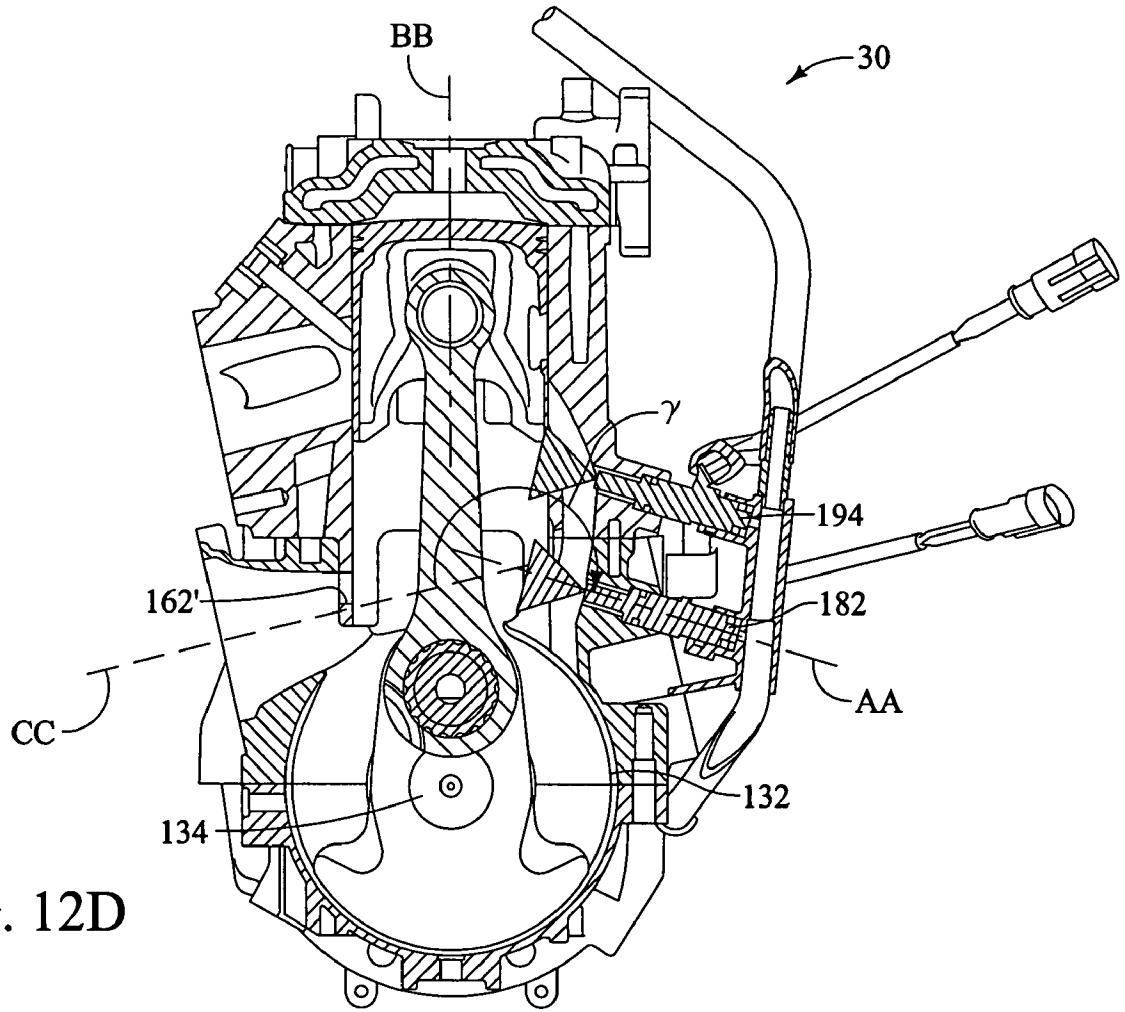
FIG. 12D shows an embodiment where the air inlet is in the cylinder.

FIG. 12D shows the embodiment where the air inlet 162 is in the cylinder 126 and is controlled by the skirt of piston 138.

In some embodiments, there are two cylinders 126 and two crankcase fuel injectors 182, although of course there may be as many cylinders and associated fuel injectors as desired. In such embodiments, the two crankcase fuel injectors 182 may be oriented on generally parallel axes, as shown by lines A and B in FIG. 11. This orientation allows a common fuel rail 190 to provide fuel to each crankcase fuel injector 182, as shown in FIGS. 6 and 9–13. In some embodiments, fuel rail 190 has a rigid (i.e., relatively less flexible) portion 192 located substantially between the crankcase fuel injectors 182, and may also connect directly to a fuel supply.

Figure 11:
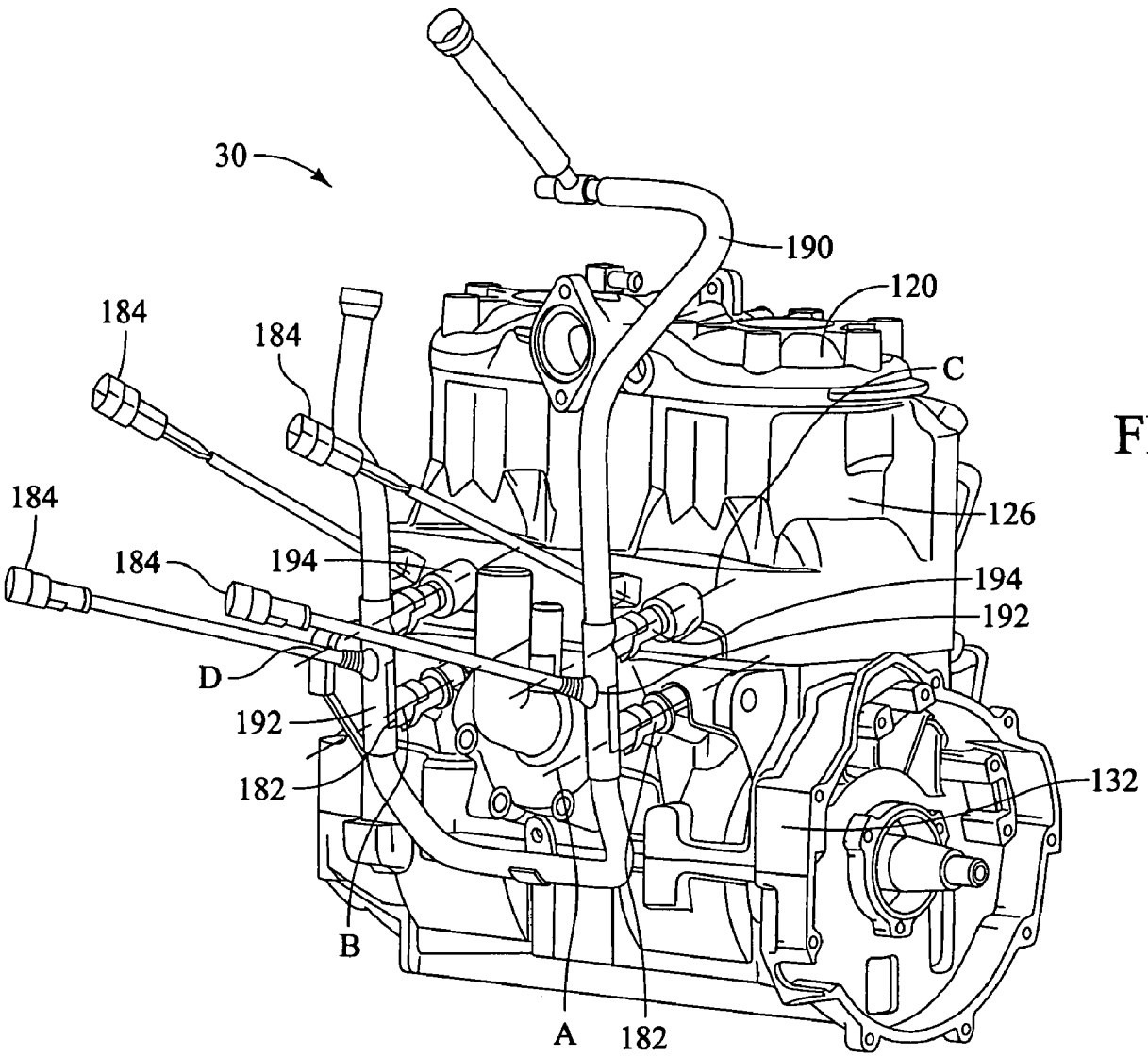
FIG. 11 shows a perspective view of an engine in accordance with an embodiment of the invention.

As shown in FIGS. 11–13, some embodiments of the engine 30 include a transfer passage fuel injector 194 passing through a wall of transfer passage 156. A fuel injector in this location may increase fuel efficiency, reduce emissions, and improve engine running quality. Transfer passage fuel injector 194 may be of any type, and may be electronically controlled. Harness 184 may be coupled to transfer passage fuel injector 194 to facilitate communication with the engine control unit.

Transfer passage fuel injector 194 may be further positioned according to the invention to increase fuel efficiency and/or promote complete combustion. Transfer passage fuel injector 194 may be positioned to dispense fuel into the transfer passage 156 in a jet directed substantially transverse to a direction of fluid (e.g., combustion air, or combustion air and fuel mixture) flow in the transfer passage 156. This orientation is particularly useful for increasing fuel atomization of the fuel injected by transfer passage fuel injector 194. In some embodiments, central axis D of transfer passage fuel injector 194 is generally parallel to central axis B of crankcase fuel injector 182, as shown in FIG. 12A. Transfer passage fuel injector 194 may also be generally perpendicular to crankshaft 124 disposed within the crankcase 132 in top view.

Crankcase fuel injector 182 and transfer passage fuel injector 194 may be placed in certain relationships to each other to promote efficiencies. In some embodiments, crankcase fuel injector 182 and transfer passage fuel injector 194 are located along generally parallel axes, as shown by lines A and C in FIG. 11. In some embodiments there are two cylinders 126, two crankcase fuel injectors 182, and two transfer passage fuel injectors 194. In such embodiments all injectors may be located along generally parallel axes, as shown by lines A, B, C, and D in FIG. 11, and common fuel rail 190 may provide fuel to each injector. In some embodiments, fuel rail 190 has rigid portion 192 located substantially between two or more of the fuel injectors.

The invention also includes a method of injecting fuel into any of the various engine embodiments described above. Such a method includes introducing air into the crankcase 132 and injecting fuel into the crankcase 132 through the crankcase fuel injector 182. Because of the placement of the crankcase fuel injector 182 and the air inlet assembly 162, the fuel is substantially atomized after injection.

Since the crankcase fuel injector 182 is located to inject fuel in a direction towards the air inlet assembly 162, as opposed to upstream of the inlet valve, the invention allows for a wide variety of fuel injection timing schemes. The fuel may be injected at any time during the rotation of the crankshaft 134. In some embodiments, fuel is continuously injected into the crankcase 132. This freedom in fuel injection timing schemes may provide for greater operating efficiency, reduced emissions, and improved engine running quality.

In embodiments provided with transfer passage fuel injector 194, the amount of fuel delivered to crankcase fuel injector 182 and transfer passage fuel injector 194 may be manipulated by the engine control unit based on different engine 30 loads. In some embodiments, substantially all of the fuel is supplied to the crankcase fuel injector 182 under full load engine 30 operating conditions. Fuel delivery may also be divided between the crankcase fuel injector 182 and the transfer passage fuel injector 194 such that transfer passage fuel injector 194 assumes a progressively larger proportion of the fuel delivery as the engine 30 load is decreased. In some embodiments, substantially all of the fuel is supplied to the transfer passage fuel injector 194 under no-load idle and/or light part-load engine 30 operating conditions. Such diverting of fuel to crankcase fuel injector 182 or transfer passage fuel injector 194 may provide for increased operating efficiency, reduced emissions, and improved running quality.

Further, to improve emissions at part load conditions, the timing of fuel injection by the transfer passage fuel injector may be manipulated such that the instantaneous fluid volume into which the fuel is injected is substantially fully trapped by the piston, thereby minimizing the quantity of unburnt fuel that exits the exhaust port 144.

Thus, embodiments of the various straddle seat type vehicles with two-stroke engines provided with crankcase fuel injection and/or transfer passage fuel injection are disclosed. One skilled in the art will appreciate that the invention can be practiced with embodiments other than those disclosed. The disclosed embodiments are presented for purposes of illustration and not limitation, and the invention is limited only by the claims that follow.

What is claimed is:

1. A straddle seat type vehicle, comprising:

a straddle type seat;

a two-cycle internal combustion engine; and a chassis supporting the seat and the engine, the engine including:

a cylinder having an internal cavity of substantially cylindrical shape and defining a central cylinder axis;

a cylinder head disposed on one end of the cylinder;

a piston disposed within the internal cavity of the cylinder;

a crankcase disposed on an end of the cylinder opposite the cylinder head and in fluid flow communication with the cylinder;

an air inlet for introducing air into the crankcase, the air flow out of the inlet and into the crankcase defining a central airflow axis; and a crankcase fuel injector passing through a wall of the crankcase for injecting fuel in the crankcase in a fuel jet having a central jet axis, the jet axis being in a direction generally opposite the direction of the central airflow axis when viewed in a direction from the cylinder head towards the crankcase and when viewed in a direction perpendicular to the central cylinder axis, wherein all of the fuel for the combustion, at all loads is injected at a position below the top of the piston, as measured at a bottom dead center position of the piston.

2. The straddle seat type vehicle of claim 1, wherein the crankcase fuel injector is positioned to inject fuel below the piston.

3. The straddle seat type vehicle of claim 2, further including a crankshaft disposed within the crankcase, and wherein the crankcase fuel injector is positioned to inject fuel between the crankshaft and the piston.

4. The straddle seat type vehicle of claim 1, further including a connecting rod operatively connecting the piston to a crankshaft disposed within the crankcase, the connecting rod including a lower connecting rod bearing, and the crankcase fuel injector being positioned to spray fuel so fuel is substantially directed away from the lower connecting rod bearing.

5. The straddle seat type vehicle of claim 1, wherein the crankcase fuel injector is positioned to spray fuel so fuel is substantially directed away from an internal surface of the crankcase.

6. The straddle seat type vehicle of claim 1, wherein there are two cylinders and two crankcase fuel injectors.

7. The straddle seat type vehicle of claim 6, wherein the two crankcase fuel injectors each define a central axis running through the center of the respective fuel injector, and the two crankcase fuel injectors being mounted such that the central axes are generally parallel.

8. The straddle seat type vehicle of claim 6, wherein a fuel rail with a rigid portion provides fuel to each crankcase fuel injector.

9. The straddle seat type vehicle of claim 1, wherein the straddle seat type vehicle is one of a snowmobile, a personal watercraft, an all terrain vehicle, and a motorcycle.

10. The straddle seat type vehicle of claim 1, further including a transfer passage communicating between the crankcase and the cylinder for conducting fluid from the crankcase to the cylinder when the piston moves toward a bottom dead center position, and a transfer passage fuel injector disposed to inject fuel into the transfer passage.

11. The straddle seat type vehicle of claim 10, wherein the transfer passage fuel injector is generally perpendicular to a crankshaft disposed within the crankcase in top view.

12. The straddle seat type vehicle of claim 10, wherein the transfer passage fuel injector is positioned to dispense fuel into the transfer passage in a jet with a center axis directed generally transverse to a direction of fluid flow in the transfer passage from the crankcase to the cylinder.

13. The straddle seat type vehicle of claim 10, wherein the crankcase fuel injector and transfer passage fuel injector each define a central axis running through the center of the respective fuel injector, and the fuel injectors being mounted such that the respective central axes are generally parallel.

14. The straddle seat type vehicle of claim 13, wherein the engine includes two cylinders, two crankcase fuel injectors, and two transfer passage fuel injectors, and the fuel injectors being mounted such that the respective central axes are generally parallel.

15. The straddle seat type vehicle of claim 14, wherein a fuel rail with a rigid portion supplies fuel to each fuel injector.

16. The straddle seat type vehicle of claim 1, wherein the crankcase fuel injector location is adapted to inject fuel in a direction toward the air inlet.

17. The straddle seat type vehicle of claim 1, wherein the air inlet is disposed in the crankcase.

18. The straddle seat type vehicle of claim 1, wherein the air inlet is disposed in the cylinder.

19. The straddle seat type vehicle of claim 1, wherein the crankcase fuel injector jet axis is directed at an angle of between 0 and 20 degrees from a plane normal to the central cylinder axis.

20. The straddle seat type vehicle of claim 1, wherein the crankcase fuel injector jet axis and the central airflow axis conjointly form an angle of between 90 and 270 degrees when viewed in the direction from the cylinder head towards the crankcase.

21. The straddle seat type vehicle of claim 1, wherein the crankcase fuel injector jet axis and the central airflow axis conjointly form an angle of between 90 and 270 degrees when viewed in the direction perpendicular to the central cylinder axis.

22. The straddle seat type vehicle of claim 1, wherein the crankcase fuel injector jet axis and the central airflow axis conjointly form an angle of between 90 and 270 degrees when viewed in the direction parallel to the crankshaft axis.

23. The straddle seat type vehicle of claim 1, wherein the crankcase fuel injector jet axis and a central axis of the crankcase fuel injector are the same.

24. The straddle seat type vehicle of claim 1, wherein the crankcase fuel injector jet axis is directed away from a lower connecting rod bearing that connects a connecting rod to a crankshaft of the engine.

25. A straddle seat type vehicle comprising:

a straddle seat type seat;

a two-cycle internal combustion engine; and a chassis supporting the engine and the straddle seat, the engine including:

a cylinder;

a piston disposed within the cylinder;

a crankcase;

a transfer passage providing fluid flow communication between the cylinder and the crankcase for conducting combustion air from the crankcase to the cylinder when the piston moves toward a bottom dead center position;

a means for introducing combustion air into the crankcase;

a crankcase fuel injector passing through a wall of the crankcase for dispensing fuel into the crankcase; and a transfer passage fuel injector passing through a wall of the transfer passage for dispensing fuel into the transfer passage.

26. The straddle seat type vehicle of claim 25, further including a crankshaft disposed within the crankcase, and wherein the crankcase fuel injector is positioned to inject fuel between the crankshaft and the piston.

27. The straddle seat type vehicle of claim 25, wherein the transfer passage fuel injector is positioned to dispense fuel into the transfer passage in a jet directed substantially transverse to a direction of fluid flow in the transfer passage from the crankcase to the cylinder.

28. The straddle seat type vehicle of claim 25, wherein the crankcase fuel injector and transfer passage fuel injector each define a central axis running through the center of the respective fuel injector, and the fuel injectors being mounted such that the respective central axes are generally parallel.

29. The straddle seat type vehicle of claim 25, wherein the engine includes two cylinders, two crankcase fuel injectors, and two transfer passage fuel injectors, and the fuel injectors being mounted such that the respective central axes are generally parallel.

30. The straddle seat type vehicle of claim 29, wherein a fuel rail with a rigid portion provides fuel to each fuel injector.

31. The straddle seat type vehicle of claim 25, wherein the straddle seat type vehicle is one of a snowmobile, a personal watercraft, an all terrain vehicle, and a motorcycle.

32. The straddle seat type vehicle of claim 25, wherein the crankcase fuel injector location is adapted to inject fuel in a direction toward the means for introducing combustion air into the crankcase.

33. The straddle seat type vehicle of claim 25, wherein the crankcase fuel injector location is adapted to inject fuel in a jet directed at incoming air entering through the means for introducing combustion air into the crankcase.

34. The straddle seat type vehicle of claim 25, wherein the means for introducing combustion air into the crankcase is disposed in the crankcase.

35. A method of injecting fuel into a two-cycle internal combustion engine comprising:

providing the engine including a cylinder, a piston disposed within the cylinder, a crankcase in fluid flow communication with the cylinder, an air inlet for introducing air into the crankcase, and a crankcase fuel injector passing through a wall of the crankcase;

introducing the air into the crankcase via the air inlet; and injecting fuel into the crankcase via the crankcase fuel injector in a direction generally opposite a direction of airflow of the air introduced into the crankcase via the air-inlet, wherein all of the fuel for the combustion at all loads is injected at a position below the top of the piston, as measured at a bottom dead center position of the piston.

36. The method of injecting fuel of claim 35, wherein the fuel is substantially atomized after injection.

37. The method of injecting fuel of claim 35, wherein the fuel is injected at any time during the rotation of a crankshaft disposed within the crankcase.

38. The method of injecting fuel of claim 35, wherein the fuel is injected continuously during the rotation of a crankshaft disposed within the crankcase.

39. The method of injecting fuel of claim 35, further including injecting fuel into a transfer passage of the engine via a transfer passage fuel injector passing through a wall of the transfer passage.

40. The method of injecting fuel of claim 39, wherein substantially all of the fuel is supplied to the crankcase fuel injector under full load engine operating conditions.

41. The method of injecting fuel of claim 39, wherein the fuel delivery is divided between the crankcase fuel injector and the transfer passage fuel injector such that the transfer passage fuel injector assumes a progressively larger proportion of the fuel delivery as the engine load is decreased.

42. The method of injecting fuel of claim 39, wherein substantially all of the fuel is supplied to the transfer passage fuel injector under no-load idle engine operating conditions.

43. The method of injecting fuel of claim 39, wherein substantially all of the fuel is supplied to the transfer passage fuel injector under part-load engine operating conditions.

44. A straddle seat type vehicle, comprising:

a straddle type seat;

a two-cycle internal combustion engine; and a chassis supporting the seat and the engine, the engine comprising:

a cylinder having an internal cavity of substantially cylindrical shape and defining a central cylinder axis;

a cylinder head disposed on one end of the cylinder;

a piston disposed within the internal cavity of the cylinder;

a crankcase disposed on an end of the cylinder opposite the cylinder head and in fluid flow communication with the cylinder;

an air inlet for introducing air into the crankcase, the air flow out of the inlet and into the crankcase defining a central airflow axis; and a fuel injector for injecting fuel for the combustion, all of the injected fuel at all loads being injected at a position below the top of the piston, as measured at a bottom dead center position of the piston.

45. The straddle seat type vehicle of claim 44, wherein the fuel injector is a crankcase fuel injector passing through a wall of the crankcase for injecting fuel in the crankcase in a fuel jet having a central jet axis.

46. The straddle seat type vehicle of claim 45, further comprising a transfer passage communicating between the crankcase and the cylinder for conducting fluid from the crankcase to the cylinder when the piston moves toward the bottom dead center position.

47. The straddle seat type vehicle of claim 46, further comprising a transfer passage fuel injector disposed to inject fuel into the transfer passage.

48. The straddle seat type vehicle of claim 44, further including a transfer passage communicating between the crankcase and the cylinder for conducting fluid from the crankcase to the cylinder when the piston moves toward the bottom dead center position.

49. The straddle seat type vehicle of claim 48, wherein the fuel injector is a transfer passage fuel injector, disposed to inject fuel into the transfer passage.

50. The straddle seat type vehicle of claim 49, further comprising a crankcase fuel injector passing through a wall of the crankcase for injecting fuel only into the crankcase, in a fuel jet having a central jet axis.

* * * * *